US008029420B1

(12) United States Patent
Thati

(10) Patent No.: US 8,029,420 B1
(45) Date of Patent: Oct. 4, 2011

(54) BLOOD CLOT RISK REDUCING APPARATUS

(76) Inventor: Yoga N. Thati, Brentwood, TN (US)

( * ) Notice: Subject to any disclaimer, the term of this patent is extended or adjusted under 35 U.S.C. 154(b) by 0 days.

(21) Appl. No.: 12/874,352

(22) Filed: Sep. 2, 2010

(51) Int. Cl.
*A63B 23/08* (2006.01)

(52) U.S. Cl. ..... 482/79; 482/80

(58) Field of Classification Search ..... 482/79–80, 482/51–53, 77; 601/32–35
See application file for complete search history.

(56) References Cited

U.S. PATENT DOCUMENTS

| | | | | |
|---|---|---|---|---|
| 4,159,111 | A | 6/1979 | Lowth | |
| 4,795,148 | A | 1/1989 | Rangaswamy | |
| 4,946,162 | A | 8/1990 | Lubie | |
| 5,181,895 | A * | 1/1993 | Larson et al. | 482/93 |
| 5,230,675 | A * | 7/1993 | Lin | 482/53 |
| 5,277,677 | A * | 1/1994 | Terauds | 482/53 |
| 5,667,462 | A * | 9/1997 | Gordon | 482/80 |
| 5,722,919 | A * | 3/1998 | Timmer | 482/79 |
| D461,211 | S | 8/2002 | Kuo | |
| 6,572,514 | B1 * | 6/2003 | Calafato | 482/79 |
| 6,705,975 | B2 * | 3/2004 | Kuo | 482/79 |
| 6,709,368 | B1 * | 3/2004 | Chue | 482/79 |
| 6,830,539 | B2 * | 12/2004 | Chuang | 482/53 |
| 7,824,315 | B2 * | 11/2010 | Piaget et al. | 482/53 |
| 7,883,451 | B2 * | 2/2011 | Hand | 482/80 |
| 2004/0210168 | A1 * | 10/2004 | Takizawa et al. | 601/5 |
| 2008/0132378 | A1 | 6/2008 | Bouchon | |

* cited by examiner

*Primary Examiner* — Fenn Mathew

(57) ABSTRACT

A blood clot risk reducing apparatus includes a frame forming a loop and including a first lateral section, a second lateral section, a front section and a back section. A rod extends between the first and second lateral sections. Two foot panels each include an upper surface, a lower surface, and a distal edge and a proximal edge with respect to the front section. The foot panels are pivotally coupled to the rod. A base is attached to the frame. A pair of foot supports is attached to and extends upwardly from the base. Each of the foot supports is attached to one of the foot panels. The foot supports are resiliently compressible and bias the distal edge of each of the foot panels upwardly. The distal edges of the foot panels are movable downward with a toe portion of a person's foot to exercise their leg muscles while seated.

8 Claims, 5 Drawing Sheets

BLOOD CLOT RISK REDUCING APPARATUS

BACKGROUND OF THE DISCLOSURE

Field of the Disclosure

The disclosure relates to blood clot prevention devices and more particularly pertains to a new blood clot prevention device for exercising a person's lower legs to prevent the formation of blood clots due to sitting for prolonged periods of time.

SUMMARY OF THE DISCLOSURE

An embodiment of the disclosure meets the needs presented above by generally comprising a frame forming a loop and including a first lateral section, a second lateral section, a front section and a back section. A rod is attached to and extends between the first and second lateral sections. The rod is positioned nearer to the front section than the back section. Each one of a pair of foot panels includes an upper surface, a lower surface and a perimeter edge, wherein the perimeter edge includes a distal edge and a proximal edge with respect to the front section. The foot panels are pivotally coupled to the rod. The rod is positioned nearer to the proximal edge than the distal edge of each of the foot panels. A base is attached to and is positioned beneath the frame. A pair of foot supports is attached to and extends upwardly from the base. One the foot supports is attached to one of the foot panels and one of the foot supports is attached to the other one of the foot panels. The foot supports are resiliently compressible and bias the distal edge of each of the foot panels above a plane of the frame. The distal edges of the foot panels are movable downward with a toe portion of a person's foot to exercise their leg muscles while seated.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF THE DRAWINGS

The disclosure will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
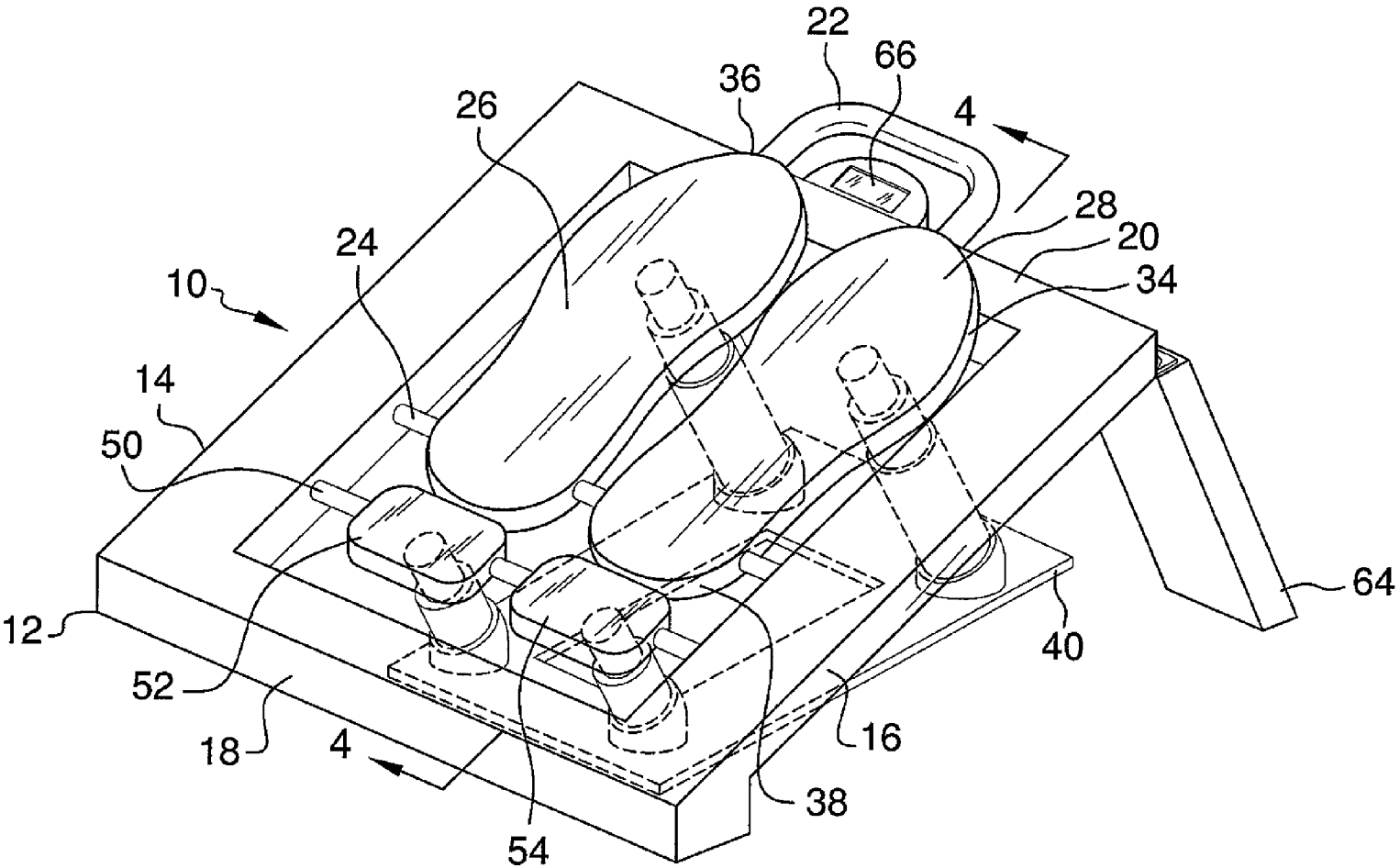
FIG. 1 is a top perspective view of a blood clot risk reducing apparatus according to an embodiment of the disclosure.
Figure 2:
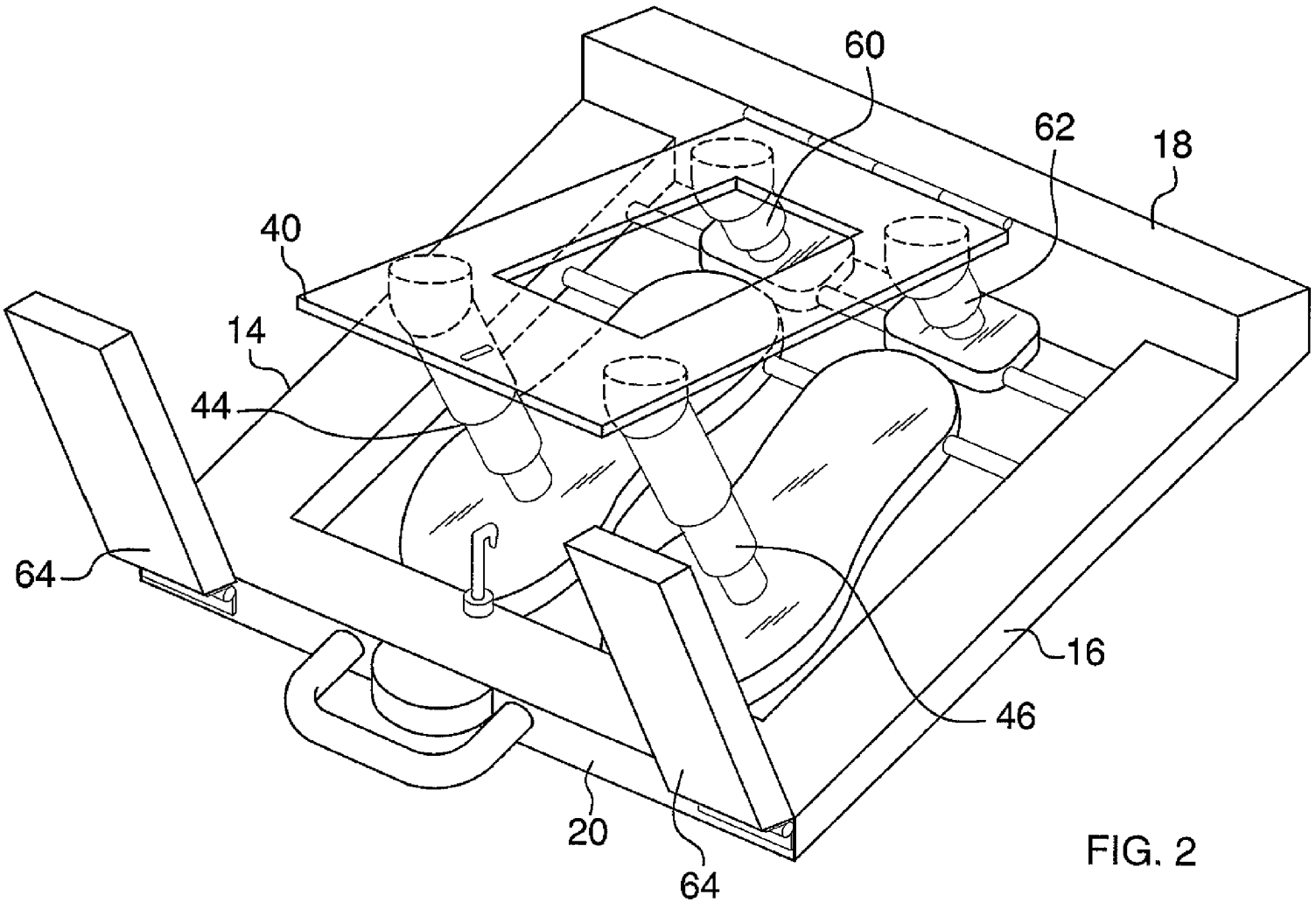
FIG. 2 is a bottom perspective view of an embodiment of the disclosure.
Figure 3:
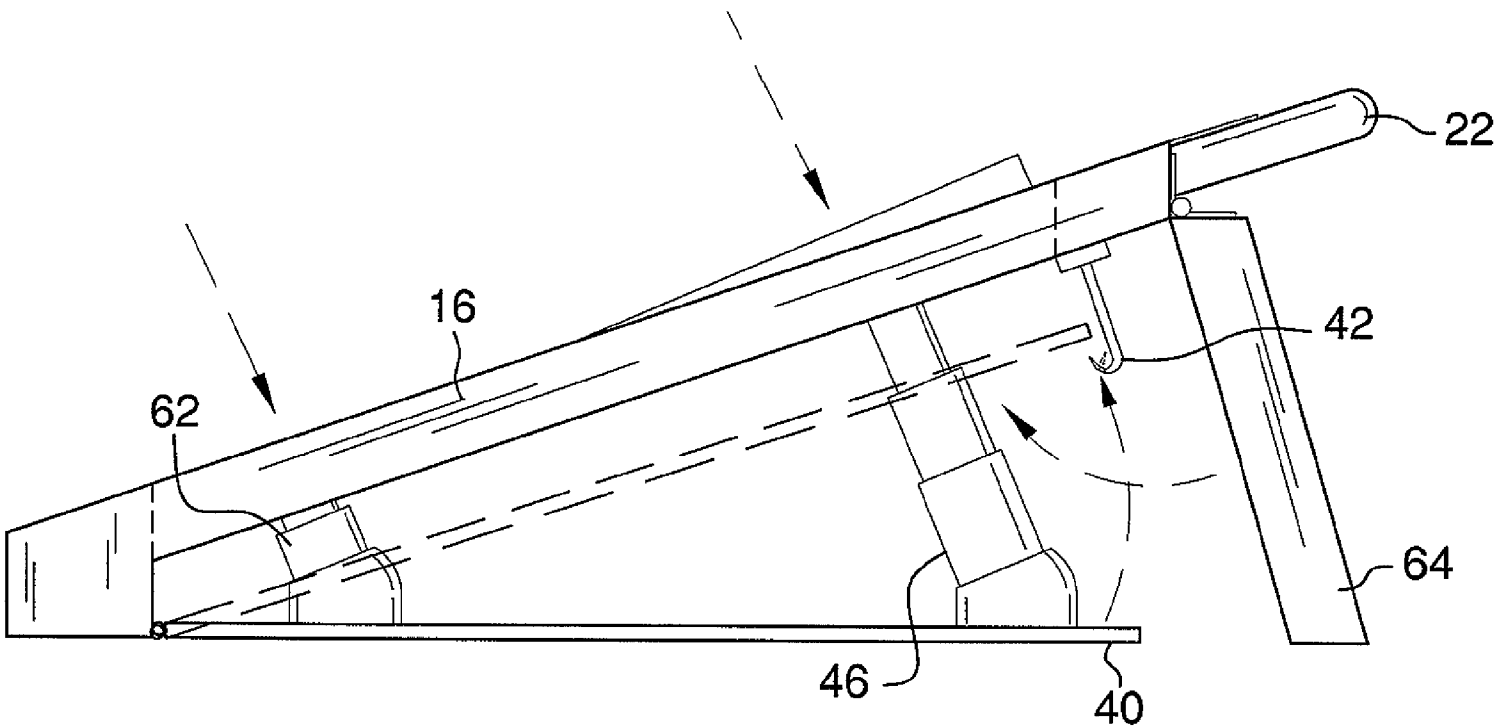
FIG. 3 is a side view of an embodiment of the disclosure.

With reference now to the drawings, and in particular to FIGS. 1 through 5 thereof, a new blood clot prevention device embodying the principles and concepts of an embodiment of the disclosure and generally designated by the reference numeral 10 will be described.

As best illustrated in FIGS. 1 through 5, the blood clot risk reducing apparatus 10 generally comprises a frame 12 forming a loop and including a first lateral section 14, a second lateral section 16, a front section 18 and a back section 20. A handle 22 is attached to the front section 18 to allow for easy transportation of the apparatus 10. A rod 24 is attached to and extends between the first 14 and second 16 lateral sections. The rod 24 is positioned nearer to the front section 18 than the back section 20.

A pair of foot panels 26, 28 is provided. Each of the foot panels 26, 28 includes an upper surface 30, a lower surface 32 and a perimeter edge 34. The perimeter edge 34 includes a distal edge 36 and a proximal edge 38 with respect to the front section 18. The foot panels 26, 28 are pivotally coupled to the rod 24 and the rod 24 is positioned nearer to the proximal edge 38 than the distal edge 36 of each of the foot panels 26, 28.

Figure 4:
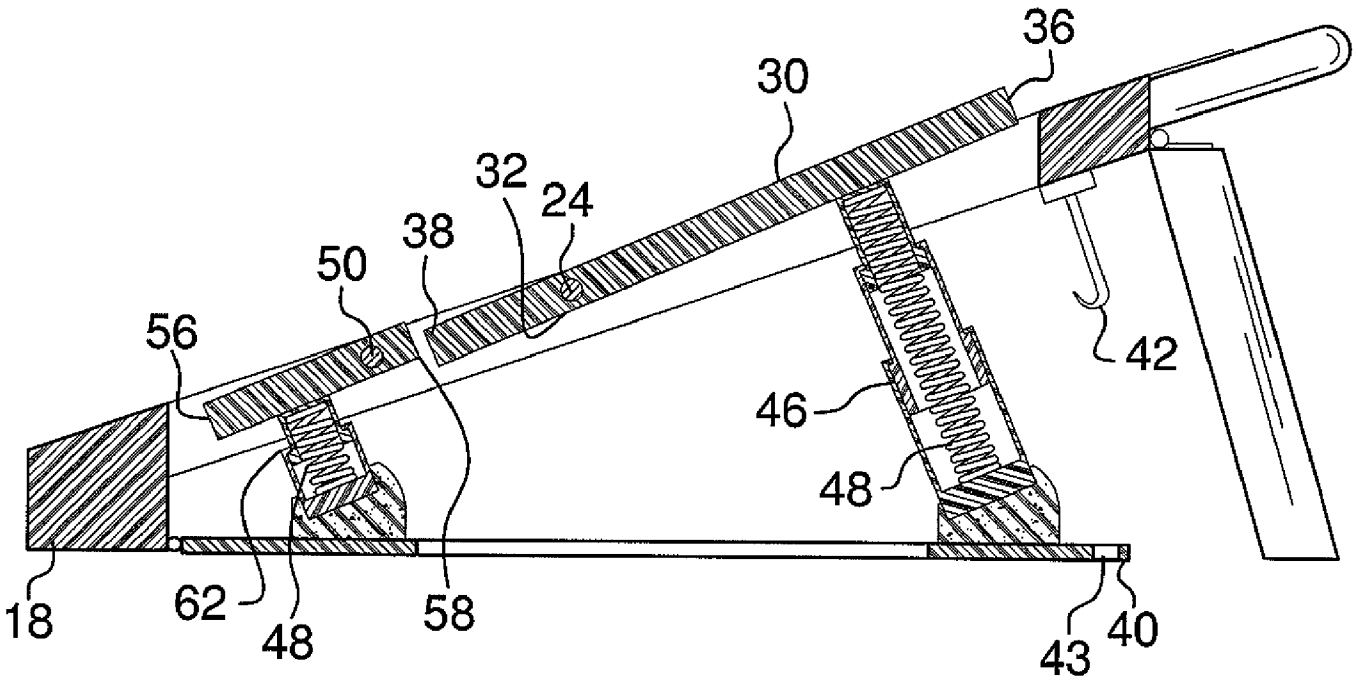
FIG. 4 is a cross-sectional view of an embodiment of the disclosure taken along line 4-4 of FIG. 1.
Figure 5:
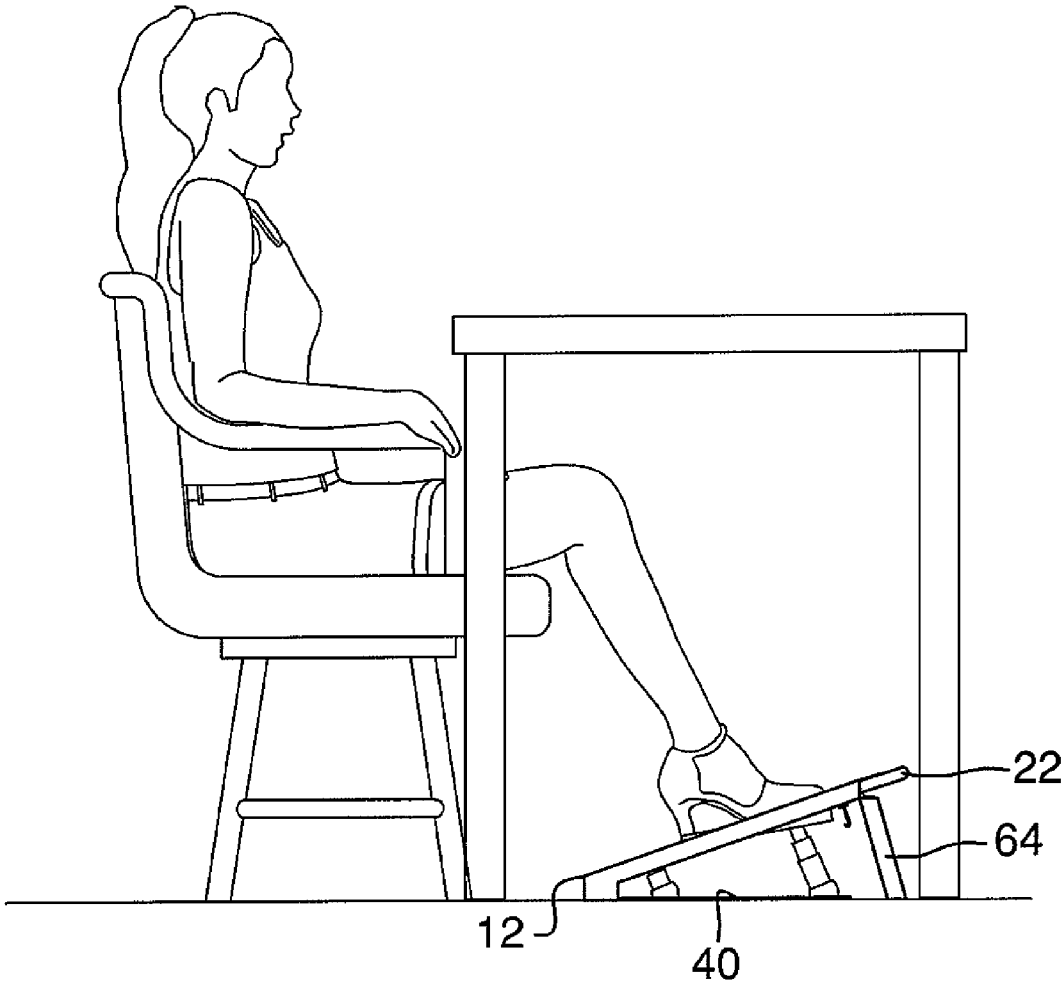
FIG. 5 is a side view of an embodiment of the disclosure.

A base 40 is attached to and positioned beneath the frame 12. The base 40 is pivotally coupled to the front section 18. This allows the base 40 to move toward a bottom of the frame 12 to be engaged with a catch 42, by way of aperture 43, for storage purposes. A pair of foot supports 44, 46 is attached to and extends upwardly from the base 40. One the foot supports 44 is attached to one of the foot panels 26 and one of the foot supports 46 is attached to the other one of the foot panels 28. The foot supports 44, 46 are resiliently compressible and bias the distal edge 36 of each of the foot panels 26, 28 above a plane of the frame 12 as shown in FIG. 4. The foot supports 44, 46 are positioned between the rod 24 and distal edges 36. Also as shown in FIG. 4, the foot supports 44, 46 may be telescopic posts having springs 48 therein to urge the foot panels 26, 28 away from the base 40.

A spindle 50 is attached to and extends between the first 14 and second 16 lateral sections. The spindle 50 is positioned between the front section 18 and the rod 24. A pair of plates 52, 54 is provided. Each of the plates 52, 54 is rotatably coupled to the spindle 50. Each of the plates 52, 54 has a near edge 56 and a far edge 58 with respect to the front section 18. The spindle 50 is positioned nearer to the far edge 58 than the near edge 56.

A pair of biasing members 60, 62 is attached to the base 40 and extends upwardly therefrom. Each of the biasing members 60, 62 is resiliently compressible. One of the biasing members 60 is attached to one of the plates 52 and one of the biasing members 62 is attached to the other one of the plates 64. The biasing members 60, 62 bias the near edges 56 of the plates 52, 54 upwardly. The biasing members 60, 62 are positioned between the spindle 50 and the near edges 56. As with the foot supports 44, 46 the biasing members 60, 62 may include telescopic post containing springs 48 retaining the biasing members 60, 62 in an extended position.

A pair of legs 64, or at least one leg 64, is attached to the frame 12 to support the back section 20 upwardly above a support surface. The legs 64 are pivotally coupled to the back section 20. This allows the legs 64 to be extended away from the back section 64 so that the legs 64 lie in plane coplanar to the frame 12 in a storage position. In a deployed position, as shown in FIG. 4, the legs 64 form an angle with respect to a bottom of the frame 12 between 65° and 120°.

In use, the distal edges 36 of the foot panels 26, 28 are movable downward with a toe portion of a person's foot and the near edges 56 are movable downward with a heal portion of a person's foot. This rocking back and forth of the foot exercises the legs, and in particular the calves, prevents the formation of blood clots in the legs. Blood clots can be formed, in particular, when a person is seated for too long of a duration such as within a vehicle or while traveling on aircraft. Being sedentary in a seated position is a primary cause of the formation of these clots and therefore the user of the apparatus 10 reduces the formation of clots by the movement of the foot panels 26, 28 and plates 52, 54 which stimulates blood flow within their legs. An electronic counter 66, conventional to exercising equipment, may be mechanically or electrically coupled to the foot panels 26, 28 and/or plates 52, 54 to provide feedback to the person using the apparatus 10 and to track their usage of the apparatus 10.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure.

I claim:

1. An exercising assembly for inhibiting the formation of blood clots in a person's legs, said assembly including:

a frame forming a loop and including a first lateral section, a second lateral section, a front section and a back section;

a rod being attached to and extending between said first and second lateral sections, said rod being positioned nearer to said front section than said back section;

a pair of foot panels, each of said foot panels including;

an upper surface, a lower surface and a perimeter edge, said perimeter edge including a distal edge and a proximal edge with respect to said front section;

said foot panels being pivotally coupled to said rod, said rod being positioned nearer to said proximal edge than said distal edge of each of said foot panels;

a base being attached to and being positioned beneath said frame, said base being pivotally coupled to said front section;

a pair of foot supports being attached to and extending upwardly from said base, one said foot supports being attached to one of said foot panels and one of said foot supports being attached to the other one of said foot panels, said foot supports being resiliently compressible and biasing said distal edge of each of said foot panels above a plane of said frame; and wherein said distal edges of said foot panels are movable downward with a toe portion of a person's foot.

2. The assembly according to claim 1, further including:

a spindle being attached to and extending between said first and second lateral sections, said spindle being positioned between said front section and said rod;

a pair of plates, each of said plates being rotatably coupled to said spindle, each of said plates having a near edge and a far edge with respect to said front section, said spindle being positioned nearer to said far edge than said near edge;

a pair of biasing members being attached to said base and extending upwardly therefrom, each of said biasing members being resiliently compressible, one of said biasing members being attached to one of said plates and one of said biasing members being attached to the other one of said plates, said biasing member biasing said near edges of said plates above said plane of said frame;

wherein said near edges are movable downward with a heel portion of a person's foot.

3. The assembly according to claim 1, further including at least one leg being attached to said frame to support said back section at a fixed vertical distance from a support surface.

4. The assembly according to claim 3, wherein said at least one leg is pivotally coupled to said back section.

5. An exercising assembly for inhibiting the formation of blood clots in a person's legs, said assembly including:

a frame forming a loop and including a first lateral section, a second lateral section, a front section and a back section;

a rod being attached to and extending between said first and second lateral sections, said rod being positioned nearer to said front section than said back section;

a pair of foot panels, each of said foot panels including;

an upper surface, a lower surface and a perimeter edge, said perimeter edge including a distal edge and a proximal edge with respect to said front section;

said foot panels being pivotally coupled to said rod, said rod being positioned nearer to said proximal edge than said distal edge of each of said foot panels;

a base being attached to and being positioned beneath said frame, said base being pivotally coupled to said front section;

a pair of foot supports being attached to and extending upwardly from said base, one said foot supports being attached to one of said foot panels and one of said foot supports being attached to the other one of said foot panels, said foot supports being resiliently compressible and biasing said distal edge of each of said foot panels above a plane of said frame;

a spindle being attached to and extending between said first and second lateral sections, said spindle being positioned between said front section and said rod;

a pair of plates, each of said plates being rotatably coupled to said spindle, each of said plates having a near edge and a far edge with respect to said front section, said spindle being positioned nearer to said far edge than said near edge;

a pair of biasing members being attached to said base and extending upwardly therefrom, each of said biasing members being resiliently compressible, one of said biasing members being attached to one of said plates and one of said biasing members being attached to the other one of said plates, said biasing member biasing said near edges of said plates above said plane of said frame;

at least one leg being attached to said frame to support said back section upwardly above a support surface, said at least one leg being pivotally coupled to said back section;

a handle being attached to said front section; and wherein said distal edges of said foot panels are movable downward with a toe portion of a person's foot and said near edges are movable downward with a heel portion of a person's foot.

6. An exercising assembly for inhibiting the formation of blood clots in a person's legs, said assembly including:

a frame forming a loop and including a first lateral section, a second lateral section, a front section and a back section;

a rod being attached to and extending between said first and second lateral sections, said rod being positioned nearer to said front section than said back section;

a pair of foot panels, each of said foot panels including;

an upper surface, a lower surface and a perimeter edge, said perimeter edge including a distal edge and a proximal edge with respect to said front section;

said foot panels being pivotally coupled to said rod, said rod being positioned nearer to said proximal edge than said distal edge of each of said foot panels;

a base being attached to and being positioned beneath said frame;

a pair of foot supports being attached to and extending upwardly from said base, one said foot supports being attached to one of said foot panels and one of said foot supports being attached to the other one of said foot panels, said foot supports being resiliently compressible and biasing said distal edge of each of said foot panels above a plane of said frame;

a spindle being attached to and extending between said first and second lateral sections, said spindle being positioned between said front section and said rod;

a pair of plates, each of said plates being rotatably coupled to said spindle, each of said plates having a near edge and a far edge with respect to said front section, said spindle being positioned nearer to said far edge than said near edge;

a pair of biasing members being attached to said base and extending upwardly therefrom, each of said biasing members being resiliently compressible, one of said biasing members being attached to one of said plates and one of said biasing members being attached to the other one of said plates, said biasing member biasing said near edges of said plates above said plane of said frame;

wherein said distal edges of said foot panels are movable downward with a toe portion of a person's foot;

wherein said near edges are movable downward with a heel portion of a person's foot.

7. The assembly according to claim 6, further including at least one leg being attached to said frame to support said back section at a fixed vertical distance from a support surface.

8. The assembly according to claim 7, wherein said at least one leg is pivotally coupled to said back section.

* * * * *